US007163337B2

(12) United States Patent
Penson

(10) Patent No.: US 7,163,337 B2
(45) Date of Patent: Jan. 16, 2007

(54) APPARATUS FOR MAINTAINING SEPARATION OF SMALL LAUNDRY ITEMS

(76) Inventor: Errol D. Penson, 5110 Sierra Cross Way, Riverside, CA (US) 92509

( * ) Notice: Subject to any disclaimer, the term of this patent is extended or adjusted under 35 U.S.C. 154(b) by 439 days.

(21) Appl. No.: 10/687,399

(22) Filed: Oct. 15, 2003

(65) Prior Publication Data

US 2005/0084182 A1 Apr. 21, 2005

(51) Int. Cl.
*B65D 30/22* (2006.01)
*B65D 33/28* (2006.01)
*B65D 30/06* (2006.01)

(52) U.S. Cl. ..... 383/38; 383/72; 383/75; 383/117

(58) Field of Classification Search ..... 383/38, 383/117, 72, 104, 75, 102; 150/112; 190/109
See application file for complete search history.

(56) References Cited

U.S. PATENT DOCUMENTS 2,437,149 A * 3/1948 Baxter ..... 383/38
3,064,872 A * 11/1962 Skirow ..... 206/433
3,279,514 A * 10/1966 Mintz ..... 220/507
5,050,998 A * 9/1991 Wachtel ..... 383/6
5,503,476 A * 4/1996 Hamdan ..... 383/9
5,797,491 A * 8/1998 Fierek et al. ..... 206/373

* cited by examiner

*Primary Examiner*—Jes F. Pascua
(74) *Attorney, Agent, or Firm*—James E. Brunton, Esq.

(57) ABSTRACT

A compartmentalized laundry bag for washing and drying small laundry items. The bag includes a collapsible mesh body having a closeable top portion, a bottom portion and a central portion. A flexible mesh bottom wall is connected to the bottom portion of the mesh body and further includes first, second, third, and fourth mesh partition walls which are disposed interiorly of the mesh body and are interconnected together at a location proximate the axial center line of the mesh body. The laundry bag also includes a drawstring arrangement for closing the top portion of the mesh body.

6 Claims, 4 Drawing Sheets

17
12
41
42
16
14
20
18
48
46
48a
26
33
28
30
32
22

APPARATUS FOR MAINTAINING SEPARATION OF SMALL LAUNDRY ITEMS

BACKGROUND OF THE INVENTION

1. Field of the Invention

The present invention relates generally to devices for use in the machine laundering of small articles. More particularly, the invention concerns a novel, compartmentalized apparatus for maintaining separation of small laundry items during machine washing and drying operations.

2. Discussion of the Prior Art

A common household problem is keeping track of small laundry items such as socks and small undergarments during washing and drying operations. If small laundry items are intermixed with larger items such as shirts, pants, dresses and the like, they tend to become tangled with the larger items and are sometimes lost, mismatched or misplaced during the sorting operations. This frequently results in the annoying mismatching of socks and the frustrations encountered in attempting to properly rematch the socks.

Several types of devices have been suggested in the past to maintain separation of small laundry items. One such device is disclosed in U.S. Pat. No. 5,500,998 issued to Wachtel. The Wachtel device comprises a dual laundry bag that has a front panel, a rear panel and a central panel which divides the laundry bag into two compartments. The rear panel includes a pair of adjustable carrying straps and the front panel includes a flap and an adjustable belt for attachment to the laundry bag of clothing which is been hung on hangers.

Another prior art laundry bag apparatus is disclosed in U.S. Pat. No. 4,630,312 issued to Milstein. This latter patent discloses an improved laundry bag construction of generally trapezoidal configuration composed of an open weave material such as a fine gauge nylon net for secure machine laundering and drying of articles made from delicate fabrics such as lingerie.

A common drawback of many prior art laundry bags is their somewhat complex and costly construction. Additionally, certain of the prior art laundry bags are bulky and are often difficult and cumbersome to use.

Accordingly, one of the primary objects of the present invention is to provide a novel, compartmentalized laundry bag that is of a simple symmetrical construction and one, which is easy to use and can be manufactured simply and inexpensively.

SUMMARY OF THE INVENTION

By way of summary, the compartmentalized laundry bag of the present invention comprises a collapsible mesh body having a closeable top portion, a bottom portion and a central portion; a flexible mesh bottom wall connected to the bottom portion of the mesh body; and first, second, third and fourth mesh partition walls which are disposed interiorly of the mesh body and are interconnected together at a location proximate the axial center line of the mesh body. In the preferred form of the invention, the laundry bag includes a drawstring arrangement for closing the top of portion of the mesh body.

With the foregoing in mind, it is an object of the present invention to provide a novel, compartmentalized laundry bag that is of a simple, symmetrical construction and one which can be manufactured easily and inexpensively using conventional fabrication processes.

A particular object of the invention is to provide a compartmentalized laundry bag of the aforementioned character that is strategically arranged to prevent the loss of small laundry items such as men's socks.

Another object of the invention is to provide a laundry bag that keeps socks in pairs throughout the entire wash and dry cycles; thereby bringing efficiency and convenience during the retrieval process by eliminating the time spent sorting through loads of laundry in an effort to rematch socks.

Another object of the invention is to provide a laundry bag of the character described that is easy and convenient to use and one that is readily receivable within and retrievable from conventional washing and drying machines.

Another object of the invention is to provide a laundry bag of the class described in the preceding paragraphs that is constructed from a netlike, mesh material having openings formed therein that are large enough to allow sufficient water flow through the openings to enable the efficient washing of the articles therewithin, but small enough to positively contain the contents within the bag.

Still another object of the invention is to provide an improved compartmentalized laundry bag which is constructed from a relatively small number of simple component parts which can be easily sewn or otherwise connected together so as to enable the manufacture of the laundry bag in a highly efficient and economical manner.

BRIEF DESCRIPTION OF THE DRAWINGS

FIG. 7 is a cross-sectional view similar to FIG. 6, but showing the top of the apparatus in a closed configuration.

DESCRIPTION OF THE INVENTION

Figures 1, 2:
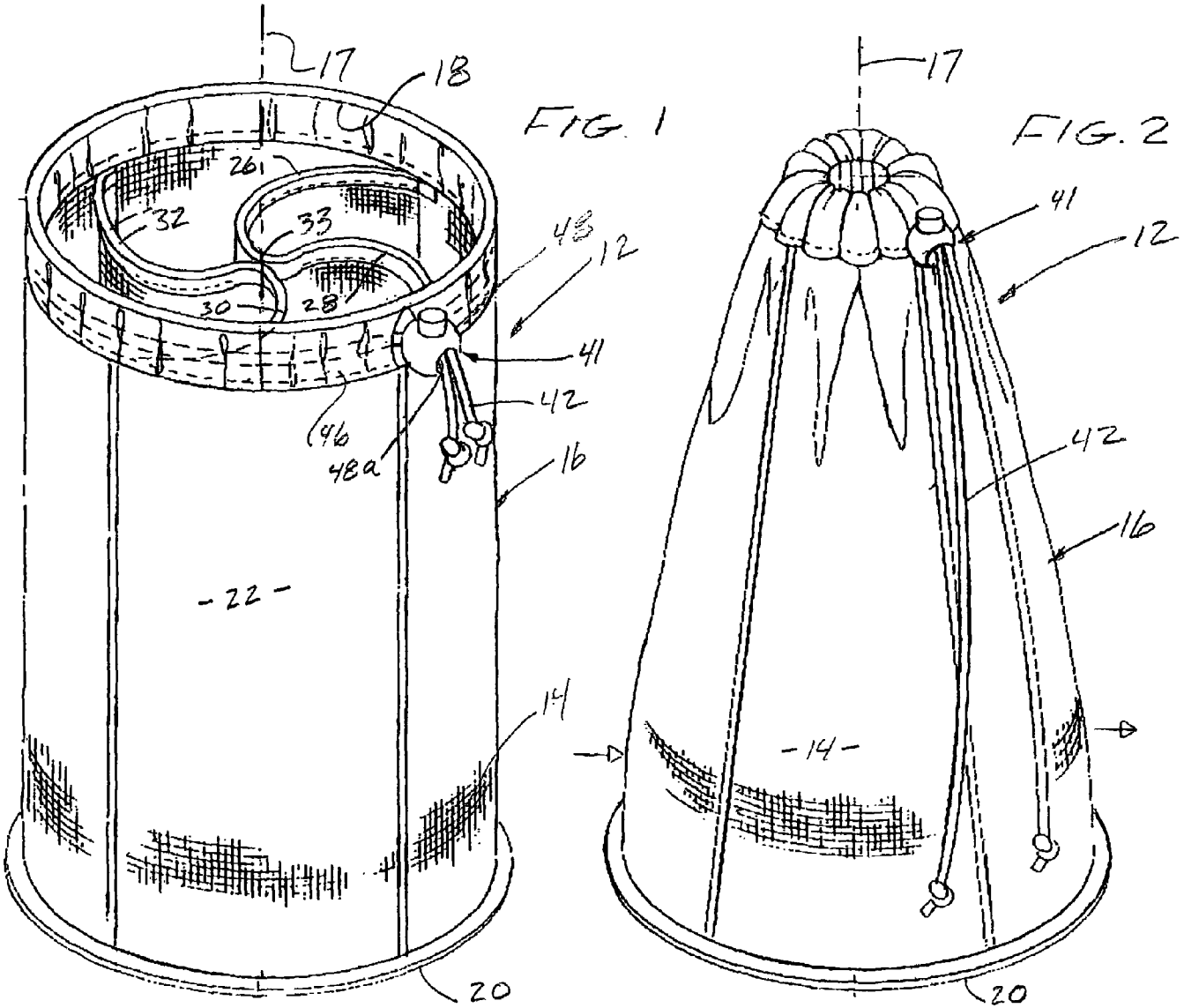
FIG. 1 is a generally perspective view of one form of the apparatus of the invention for maintaining separation of small laundry items.
FIG. 2 is a generally perspective view similar to FIG. 1, but showing the top of the apparatus in a closed configuration.

Referring to the drawings and particularly to FIGS. 1 and 2, one form of the compartmentalized laundry bag of the present invention is there shown and generally designated by the numeral 12. The novel and improved laundry bag of the invention here includes a flexible mesh sidewall 14, which, in the upright, article loading configuration shown in FIG. 1, defines a generally cylindrically shaped, collapsible body 16. Body 16 has an end axial center line 17, an open top portion 18, a bottom portion 20 and a central portion 22. A flexible mesh bottom wall 24 is connected to mesh sidewall 14 proximate the bottom portion thereof (FIG. 3).

Figure 8:
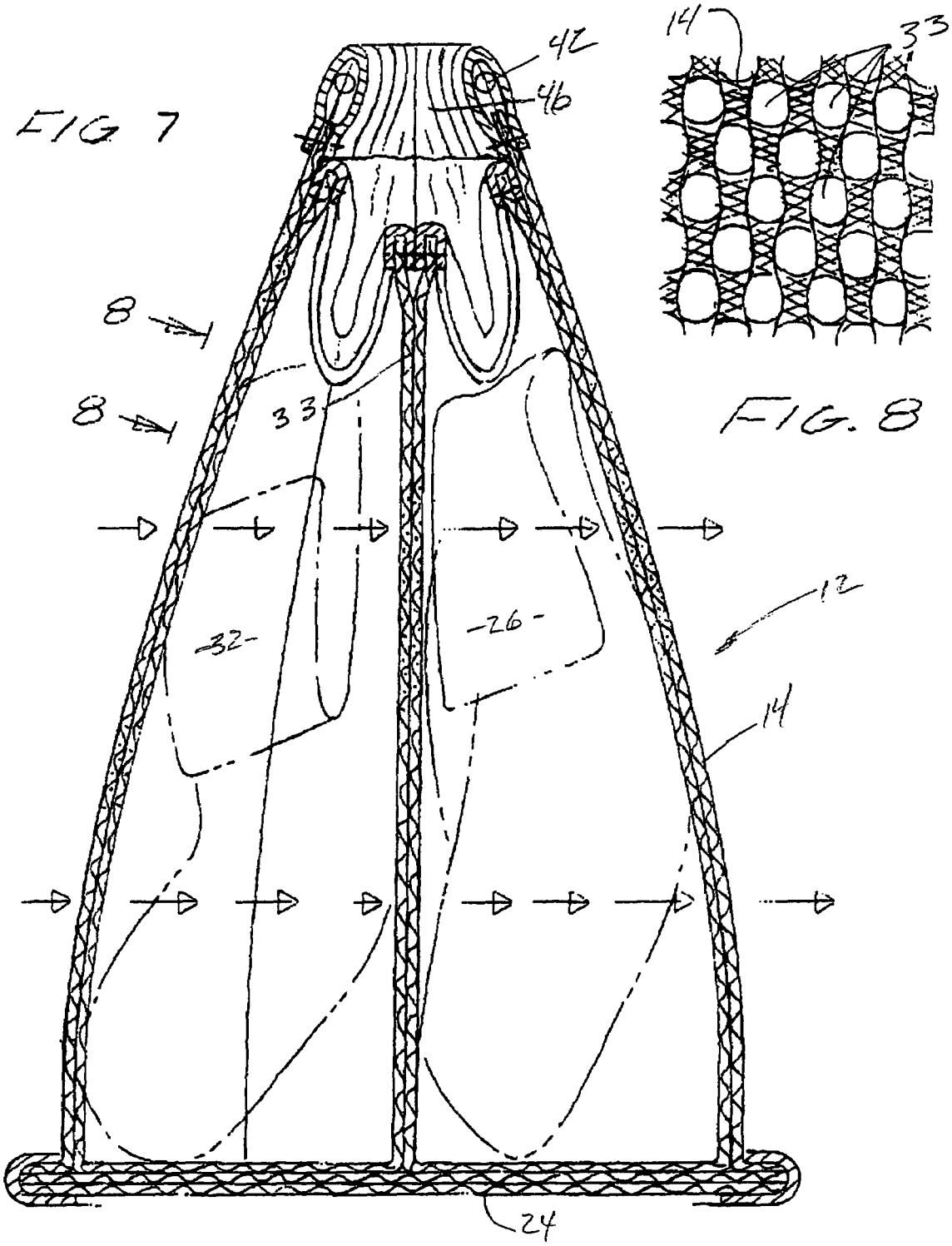
FIG. 8 is a greatly enlarged, cross-sectional view taken along lines 8—8 of FIG. 7.

Forming a novel feature of the apparatus of the present invention are first, second, third and fourth mesh partition walls 26, 28, 30 and 32 respectively. As best seen in FIGS. 1 and 3 these partition walls are disposed interiorly of the central portion of cylindrically shaped body 16 and are interconnected along their outer edges with mesh sidewall 14 as by sewing or the like. Uniquely, the partition walls are interconnected together along their inner edges as by sewing or the like at a location 33 which is proximate axial center line 17 of body 16. With this novel construction the partition walls functions to divide interior of collapsible body 16 into four compartments 34, 36, 38, and 40, which are substantially of equal size (FIG. 3). Partition walls 26, 28, 30 and 32, like side wall 14, are preferably constructed from a flexible, netlike mesh material, having a multiplicity of openings 33 (FIG. 8) which permit the free flow of water therethrough, and, when in the position shown and FIGS. 1 and 3, are curved in the manner shown in the drawings.

To retain the articles of clothing within the flexible bag during the washing and drying operations, closure means are provided for closing the top portion of the cyndrically shaped body portion. As shown in the drawings, these closure means are here provided in the form of a conventional drawstring assembly generally designated by the numeral 41.

Figure 3:
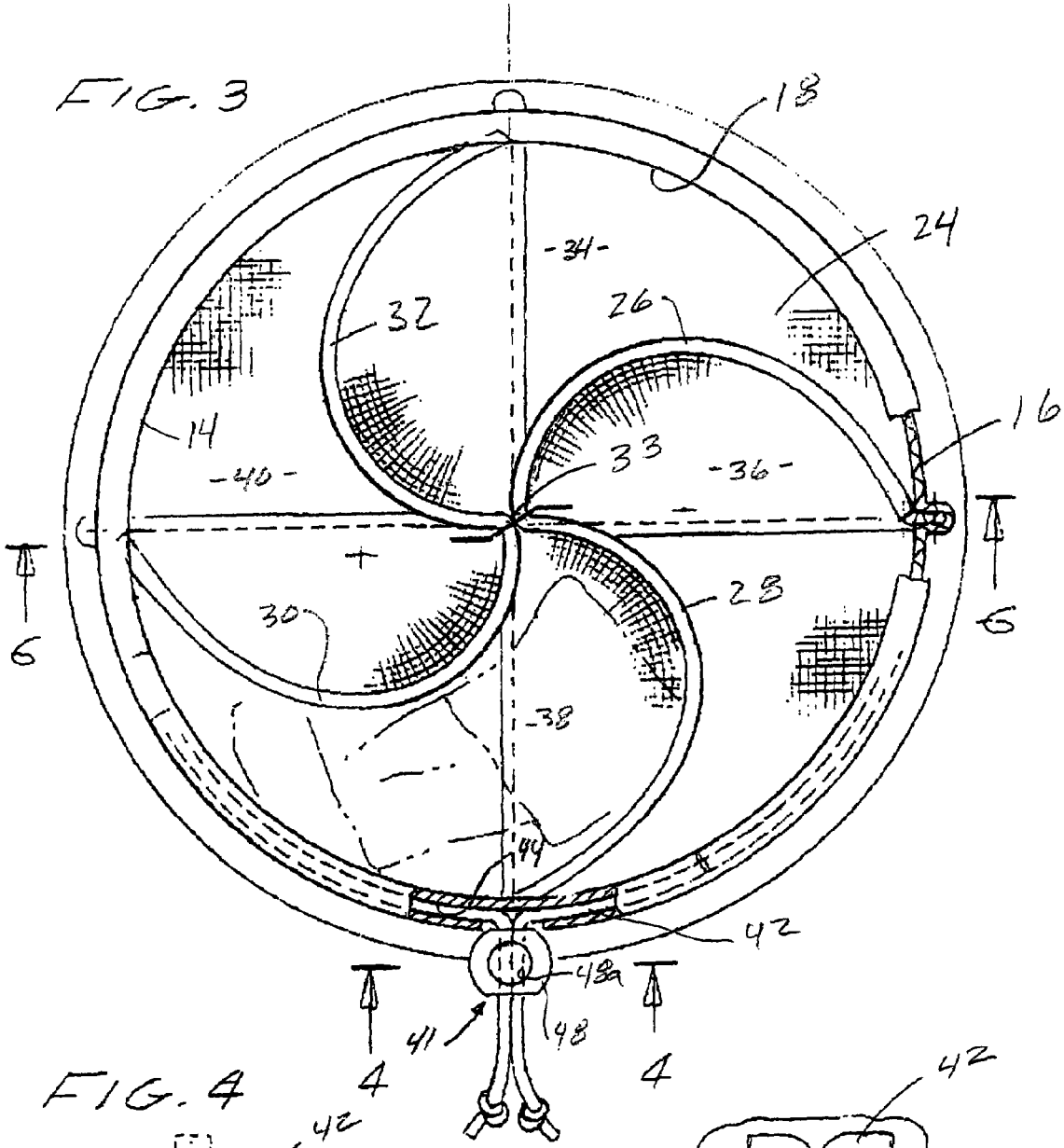
FIG. 3 is an enlarged top view of the apparatus partly broken away to show internal construction.
Figure 4:
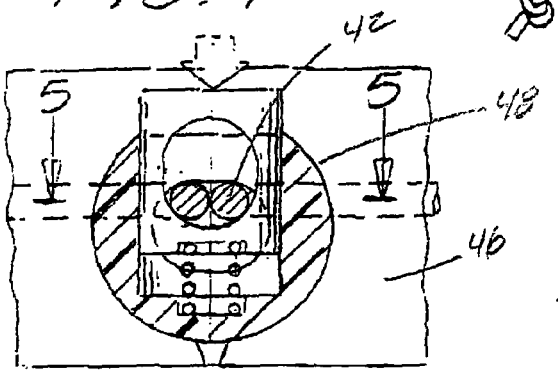
FIG. 4 is an enlarged, cross-sectional view taken along lines 4—4 of FIG. 3.
Figure 5:
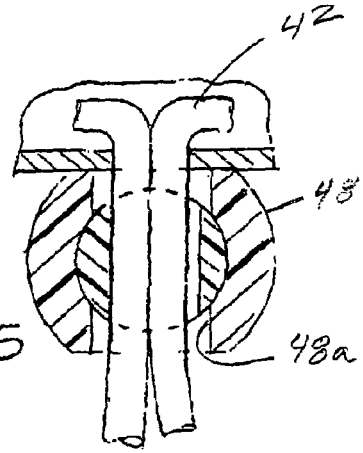
FIG. 5 is a cross-sectional view taken along lines 5—5 of FIG. 4.
Figure 6:
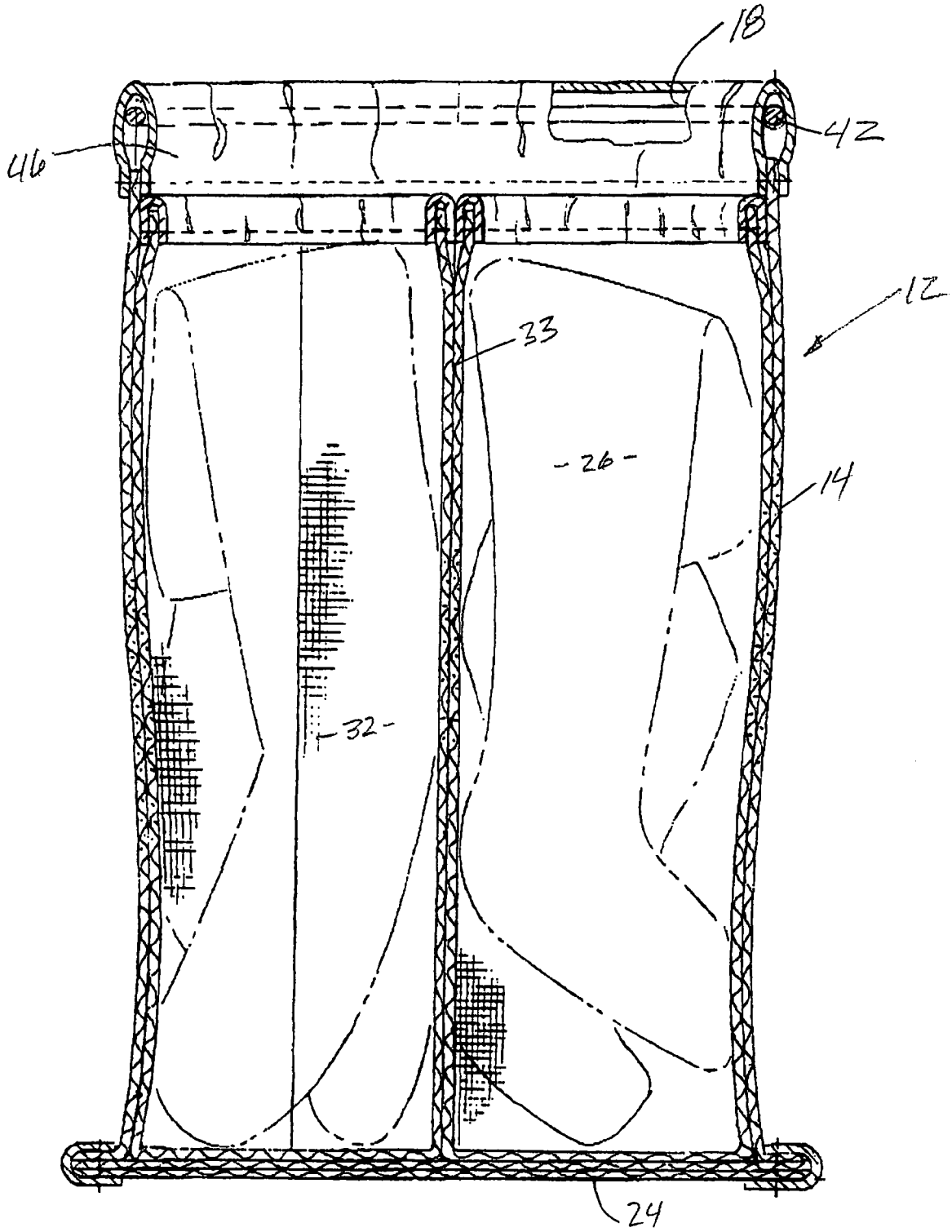
FIG. 6 is a cross-sectional view taken along lines 6—6 of FIG. 3.

As best seen in FIGS. 3, 4, and 5, the drawstring assembly of the present form of the invention comprises an elongated drawstring 42 which is threadably receivable within a passageway 44 that is formed proximate top opening 18 of the apparatus by means of a downwardly extending skirt-like portion 46 (FIG. 1) that is sewn proximate its lower extremity to the sidewall 14. The free ends of drawstring pass through a central bore 48a which is formed in generally spherical-shaped closure member 48. With this construction, when it is desired to move the apparatus from the open article receiving or loading configuration shown in FIG. 1 to the top closed configuration shown in FIG. 2, an inward pressure on spherical member 48, along with a outward force exerted on the drawstring, will cause the drawstring assembly to move from the configuration shown in FIG. 1 into the closed configuration shown in FIG. 2 wherein the top portion of the apparatus is closed to prevent accidental escape of the small articles of laundry that have been inserted into the spaced-apart compartments 34, 36, 38, and 40.

In using the apparatus of the invention, the small articles of laundry to be washed are first inserted into the four compartments 34, 36, 38, and 40 while the apparatus is in the top open configuration shown in FIG. 1. After the various compartments have been appropriately loaded with the small articles to be laundered, the apparatus can be moved into the closed configuration shown in FIGS. 2 and 7 by pushing on the spherical member 48 and at the same time pulling outwardly on the drawstring 42 so as to move the closure means into the closed configuration shown in FIG. 2. After the washing cycle has been completed, the apparatus can be opened into the configuration shown in FIG. 1 by pulling outwardly on the locking sphere 48 in a manner so that it slides outwardly along the drawstring into the position shown in FIG. 1.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A laundry bag for holding small laundry items comprising:

(a) a flexible mesh sidewall formed of a net material which permits the flow of water therethrough, which in an upright configuration defines generally cylindrically shaped, collapsible body having an open top portion, a bottom portion and a central portion, said generally cylindrically shaped collapsible body having an axial center line, said sidewall including an upper portion having a passageway formed therein;

(b) a flexible mesh bottom wall formed of a net material which permits the flow of water therethrough, said bottom wall being connected to said mesh sidewall proximate said bottom portion thereof; and (c) first, second, third and fourth partition walls formed of a net material which permits the flow of water therethrough, said partition walls being interconnected with said mesh sidewall and disposed interiorly of said central portion of said cylindrically shaped body for dividing said central portion into four compartments, said first, second, third and forth partition walls being interconnected together at a location proximate said axial center line of said generally cylindrically shaped collapsible body; and (d) closure means for closing said top portion of said generally cylindrically shaped body portion, said closure means comprising an elongated drawstring threadably received within said passageway formed in said upper portion of said sidewall.

2. The laundry bag as defined in claim 1 in which said four compartments are of substantially equal size.

3. The laundry bag as defined in claim 1 in which said first, second, third and fourth partition walls are curved.

4. The laundry bag as defined in claim 1 further including a skirt portion sewn to said upper portion of said sidewall, said skirt portion cooperating with said sidewall to form said passageway.

5. The laundry bag as defined in claim 4 in which said drawstring has free ends and in which said laundry bag further comprises a closure member having a central bore, said free ends of said drawstring passing through said central bore.

6. The laundry bag as defined in claim 5 in which said closure member is spherical.

* * * * *